US007421987B2

(12) United States Patent
Lou

(10) Patent No.: US 7,421,987 B2
(45) Date of Patent: Sep. 9, 2008

(54) VARIABLE VALVE ACTUATOR WITH LATCH AT ONE END

(75) Inventor: Zheng Lou, Plymouth, MI (US)

(73) Assignee: LGD Technology, LLC, Plymouth, MI (US)

( * ) Notice: Subject to any disclaimer, the term of this patent is extended or adjusted under 35 U.S.C. 154(b) by 0 days.

(21) Appl. No.: 11/800,586

(22) Filed: May 7, 2007

(65) Prior Publication Data

US 2007/0272180 A1 Nov. 29, 2007

Related U.S. Application Data

(60) Provisional application No. 60/809,117, filed on May 26, 2006.

(51) Int. Cl.
*F01L 9/02* (2006.01)

(52) U.S. Cl. ..... 123/90.12; 123/90.15

(58) Field of Classification Search ..... 123/90.12, 123/90.15; 251/25; 91/356, 392, 508; 137/906
See application file for complete search history.

(56) References Cited

U.S. PATENT DOCUMENTS 5,421,359 A * 6/1995 Meister et al. ..... 137/12
5,595,148 A * 1/1997 Letsche et al. ..... 123/90.12
6,543,225 B2 4/2003 Scuderi

OTHER PUBLICATIONS

*Schuderi Group, L.L.C., Plaintiff* vs. *LGD Technology, LLC and Zheng (David) Lou, Ph.D., Defendants*, Civil Complaint, U.S. District Court, District of Massachusetts.

* cited by examiner

*Primary Examiner*—Zelalem Eshete

(57) ABSTRACT

Actuators and corresponding methods and systems for controlling such actuators offer efficient, fast, flexible control with large forces. In an exemplary embodiment, an fluid actuator includes a housing having first and second fluid ports, an actuation cylinder in the housing defining a longitudinal axis and having first and second ends in first and second directions, an actuation piston in the cylinder with first and second surfaces moveable along the longitudinal axis, a spring subsystem biasing the actuation piston to a neutral position, a first fluid space defined by the first end of the actuation cylinder and the first surface of the actuation piston, a second fluid space defined by the second end of the actuation cylinder and the second surface of the actuation piston; and a flow bypass that short-circuits the first and second fluid spaces when the actuation piston is not proximate to the second end of the actuation cylinder. A first flow mechanism controls fluid communication between the first fluid space and the first port, whereas a second flow mechanism controls fluid communication between the second fluid space and the second port. The first flow mechanism is always wide-open, whereas the second flow mechanism is open and closed when the flow bypass is closed and open, respectively. The system is able to latch the actuation piston at its second direction end position while making it possible for the actuation piston not to dwell at its first direction end position, thus reducing the overall actuation time.

25 Claims, 10 Drawing Sheets

VARIABLE VALVE ACTUATOR WITH LATCH AT ONE END

REFERENCE TO RELATED APPLICATION

This application claims priority to Provisional U.S. Patent Application No. 60/809,117, file on May 26, 2006, the entire content of which are incorporated herein by reference.

FIELD OF THE INVENTION

This invention relates generally to actuators and corresponding methods and systems for controlling such actuators, and in particular, to actuators offering efficient, fast, flexible control with large forces.

BACKGROUND OF THE INVENTION

A split four-stroke cycle internal combustion engine is described in U.S. Pat. No. 6,543,225. It includes at least one power piston and a corresponding first or power cylinder, and at least one compression piston and a corresponding second or compression cylinder. The power piston reciprocates through a power stroke and an exhaust stroke of a four-stroke cycle, while the compression piston reciprocates through an intake stroke and a compression stroke. A pressure chamber or cross-over passage interconnects the compression and power cylinders, with an inlet check valve providing substantially one-way gas flow from the compression cylinder to the cross-over passage, and an outlet or cross-over valve providing gas flow communication between the cross-over passage and the power cylinder. The engine further includes an intake and an exhaust valve on the compression and power cylinders, respectively. The split-cycle engine according to the referenced patent and other related developments potentially offers many advantages in fuel efficiency, especially when integrated with an additional air storage tank interconnected with the cross-over passage, which makes it possible to operate the engine as an air hybrid engine. Relative to an electrical hybrid engine, an air hybrid engine can potentially offer as much, if not more, fuel economy benefits at much lower manufacturing and waste disposal costs.

To achieve the potential benefits, the air or air-fuel mixture in the cross-over passage has to be maintained at a predetermined firing condition pressure, e.g. approximately 270 psi or 18.6 bar gage-pressure, for the entire four stroke cycle. The pressure may go much higher to achieve better combustion efficiency. Also, the opening window of the cross-over valve has to be extremely narrow, especially at medium and high engine speeds. The cross-over valve opens when the power piston is at or near the top dead center (TDC) and closes very shortly after that. The total opening window in a split cycle engine may be as short as one to two milliseconds, compared with a minimum period of six to eight milliseconds in a conventional engine. To seal against a persistently high pressure in the cross-over passage, a practical cross-over valve is most likely a poppet or disk valve with an outward (i.e. away from the power cylinder, instead of into it) opening motion. When closed, the valve disk or head is pressured against the valve seat under the cross-over passage pressure. To open the valve, an actuator has to provide an extremely large opening force to overcome the pressure force on the head as well as the inertia. The pressure force will drop dramatically once the cross-over valve is open because of a substantial pressure-equalization between the cross-over passage and the power cylinder. Once the combustion is initiated, the valve should be closed as soon as desired to prevent the spread of the combustion into the cross-over passage, which also entails a need, during a certain period of combustion, to keep the valve seated against a power cylinder pressure that is higher than the cross-over passage pressure. In addition, the cross-over valve needs to be deactivated when the power stroke is not active in certain phases of the air hybrid operation. Like conventional engine valves, the seating velocity of the cross-over valve has to be kept under certain limit to reduce noise and maintain adequate durability.

In summary, the cross-over valve actuator has to offer a large opening force, a substantial seating force, a reasonable seating velocity, a high actuation speed, and timing flexibility while consuming minimum energy by itself Most, if not all, engine valve actuation systems are not able to meet these demands.

SUMMARY OF THE INVENTION

Briefly stated, in one aspect of the invention, one preferred embodiment of an fluid actuator includes a housing having first and second fluid ports, an actuation cylinder in the housing defining a longitudinal axis and having first and second ends in first and second directions, an actuation piston in the cylinder with first and second surfaces moveable along the longitudinal axis, a spring subsystem biasing the actuation piston to a neutral position, a first fluid space defined by the first end of the actuation cylinder and the first surface of the actuation piston, a second fluid space defined by the second end of the actuation cylinder and the second surface of the actuation piston; and a flow bypass that short-circuits the first and second fluid spaces when the actuation piston is not proximate to the second end of the actuation cylinder. A first flow mechanism controls fluid communication between the first fluid space and the first port, whereas a second flow mechanism controls fluid communication between the second fluid space and the second port. The first flow mechanism is always wide-open, whereas the second flow mechanism is open and closed when the flow bypass is closed and open, respectively.

In operation, the spring subsystem, the actuation piston, and the actuator load (e.g., an engine valve) work as a spring-mass pendulum system, efficiently converting, the potential energy in the spring subsystem to the kinetic energy in the moving mass and vice versa. The efficient energy conversion also leaves less energy for the snubbing mechanism to dissipate and provides better soft seating for the engine valve. The actuation efficiency is also greatly helped by the flow bypass, which, when effective, is able to minimize fluid flow and energy consumption. The system is able to latch the actuation piston at its second direction end position while making it possible for the actuation piston not to dwell at its first direction end position, thus reducing the overall actuation time. The actuator can be supplied and controlled by a 4-way actuation switch valve, two actuation 3-way valves, or one actuation 3-way valve.

In another embodiment, the second flow mechanism is always wide open, whereas the first flow mechanism is open and closed when the flow bypass is closed and open, respectively. The system is able to latch the actuation piston at its first direction end position while making it possible for the-piston not to dwell at its second direction end position.

In another embodiment, a spring controller allows the engine valve to close at power-off and provides a means for an effective start-up.

The present invention provides significant advantages over the prevailing fluid actuators and their control. Its ability to latch the actuator only at one end and allow a quick return motion at the other end greatly saves actuation time, which is important or critical in many applications, especially for the cross-over valve in an air hybrid engine. The fluid nature of the actuator provides high force and power density to deal with the demanding requirements, and yet the bypass mechanism is able to offer high energy efficiency. The control approaches associated with various switch valves are able to deal varying application needs, especially those for an air hybrid engine. With its pendulum arrangement, there is a centering or returning spring force available, in addition to a differential fluid force, to help open the engine valve.

The present invention, together with further objects and advantages, will be best understood by reference to the following detailed description taken in conjunction with the accompanying drawings.

DETAILED DESCRIPTION OF THE INVENTION

Figure 1:
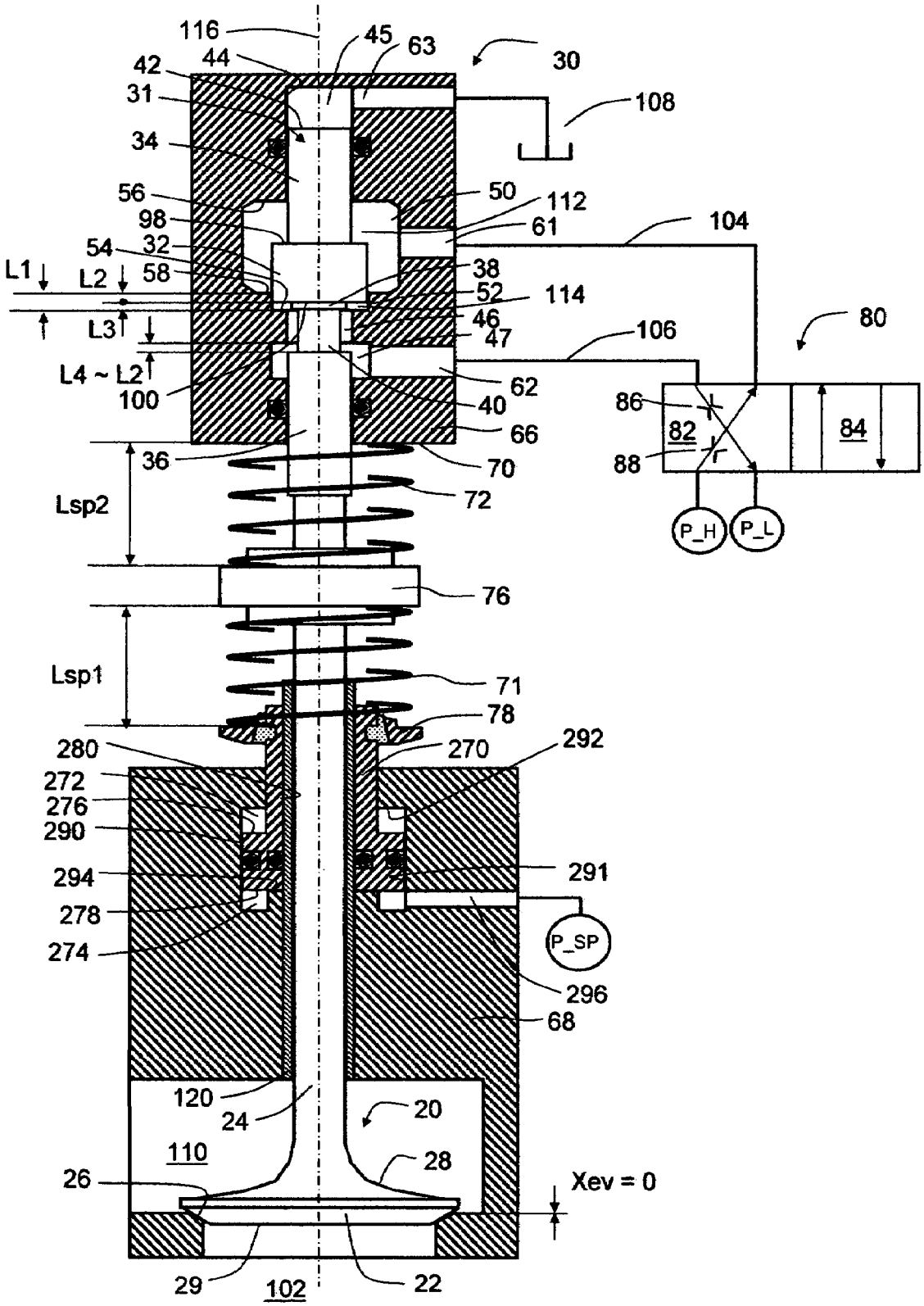
FIG. 1 is a schematic illustration of one preferred embodiment of the valve actuator, which is at its power-off state.

Referring now to FIG. 1, a preferred embodiment of the invention provides an engine valve control system using one piston, one or more bypass passages, and a set of centering spring means. The system comprises an engine valve 20, a fluid actuator 30, an actuation switch valve 80, a pair of actuation springs 71 and 72, and a spring control 270.

Figure 3:
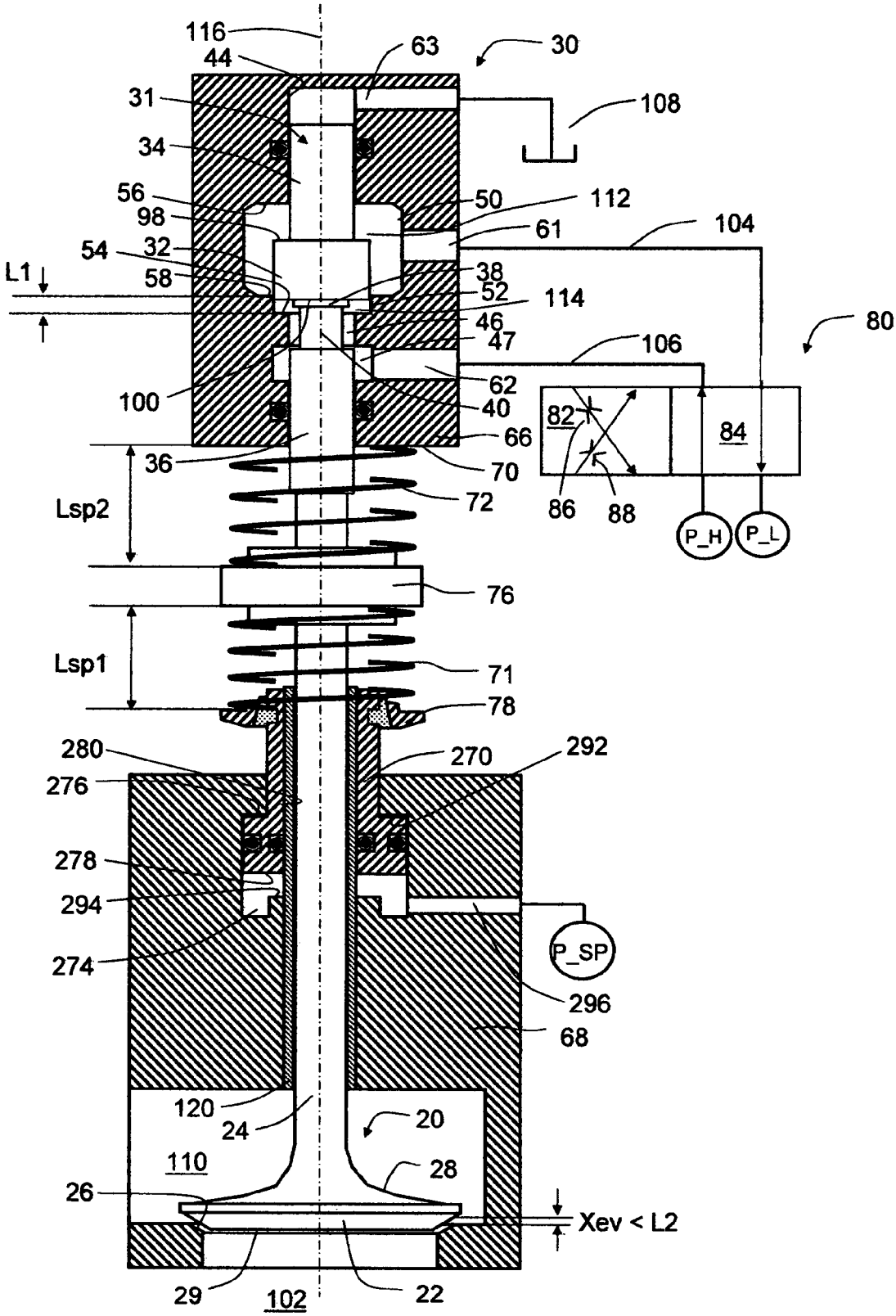
FIG. 3 is a schematic illustration of one preferred embodiment of the valve actuator, which is just opening up an engine valve, with the bypass being closed.

The actuation switch valve 80 supplies the fluid actuator 30 through a first port 61, a first-port passage 104, a second port 62, and a second-port passage 106. The first port 61 and the first-port passage 104 may be a physically or functionally continuous part, and so do the second port 62 and the second-port passage 106. The valve 80 is a 2-position 4-way valve. It has four ports connected with a low-pressure P_L fluid line, a high-pressure P_H fluid line, the first-port passage 104, and the second-port passage 106. It is switched either to a left position 82 and a right position 84. At the left position as shown in FIG. 1, the first-port and second-port passages 104 and 106 are in fluid communication with the P_H and P_L lines, respectively. At the right position (as shown in FIG. 3), the first-port and second-port passages 104 and 106 are in fluid communication with the P_L and P_H lines, respectively.

The pressure P_H can be either constant or continuously variable. When variable, it is controlled to accommodate variability in system friction, engine valve opening, air pressure, the engine valve seating velocity requirement, etc. and/or to save operating energy when possible. A higher P_H value helps overcome higher system friction and air pressure force, and increase the engine valve opening, whereas a lower P_H value is better for softer seating of the engine valve and for saving energy. The pressure P_L can be simply the fluid tank pressure, the atmosphere pressure, or a fluid system backup pressure. The fluid system backup pressure can be supported or controlled, for example, by a spring-loaded check valve, with or without an accumulator. The P_L value is preferred to be as low as possible to increase the system efficiency, and yet high enough to help prevent fluid cavitation.

The engine valve 20 includes an engine valve head 22 and an engine valve stem 24. The engine-valve head 22 includes a first surface 28 and a second surface 29, which in the case of a split-cycle engine, are exposed to a cross-over passage 110 and the engine cylinder 102, respectively. The engine valve 20 is operably connected with the fluid actuator 30 along a longitudinal axis 116 through the engine valve stem 24, which is slideably disposed in an engine valve guide 120. When the engine valve 20 is fully closed, the engine valve head 22 is in contact with an engine valve seat 26, sealing off the fluid communication between the cross-over passage 110 and the engine cylinder 102.

The fluid actuator 30 comprises an actuator housing 66, within which, along the longitudinal axis 116 and from a first to a second direction (from the top to the bottom in the drawing), there are a first bore 44, an actuation cylinder 52, and a second bore 46. The actuation cylinder 52 includes a bypass undercut 50, a first end 56, and a second end 54. The second bore 46 is interrupted by a second-bore undercut 47. Within these hollow elements from the first to the second direction lies a shaft assembly 31 comprising a first piston rod 34, an actuation piston 32, a second-piston-rod shoulder 38, a second-piston-rod neck 40, and a second piston rod 36. The first and second piston rods 34 and 36 are slideably disposed in and substantially supported in the radial direction by the first and second bores 44 and 46. The actuation piston 32 is slideably disposed in the actuation cylinder 52 when the shaft assembly 31 is at and near its second direction end of the stroke or travel.

The actuation piston 32 longitudinally divides the actuation cylinder 52 into a first fluid space 112 (between the actuation-cylinder first end 56 and the actuation-piston first surface 98) and a second fluid space 114 (between the actuation-piston second surface 100 and the actuation-cylinder second end 54). The two fluid spaces 112 and 114 are interconnected or in fluid communication through the bypass undercut 50 when the actuation-piston second surface 100 is over the bypass edge 58 in the first direction. When this flow bypass is effective, the two fluid spaces 112 and 114 and thus two actuation-piston surfaces 98 and 100 are under substantially the same pressure. This bypass effect does not substantially short-circuit the two ports 61 and 62 by making L4 substantially equal to L2, where L2 is the maximum longitudinal overlap between the actuation piston 32 and the non-bypass part of the actuation cylinder 52, and L4 is the maximum longitudinal underlap between the second piston rod 36 and the second bore 46.

The radial clearances between the above sliding surfaces are substantially tight, provide substantial fluid seal, and yet offer tolerable resistance to relative motions, including translation along and, if desired, rotation around the longitudinal axis 116, between the shaft assembly 31 and the housing 66.

The actuation cylinder 52, including the portion with the bypass undercut 50, offers substantial axial length such that the actuation piston 32 does not contact its first end 56 at any operating condition. When the engine valve 20 is seated as shown in FIG. 1, there is still a distance L3 between the actuation-piston second surface 100 and the actuation-cylinder second end 54 to accommodate the engine valve lash adjustment.

Concentrically wrapped around the engine valve stem 24 and the second piston rod 36, respectively, are a first actuation spring 71 and a second actuation spring 72. The second actuation spring 72 is supported by a housing surface 70 and a first spring retainer, 76, whereas the first actuation spring 71 is supported by the first and a second spring retainers 76 and 78. The actuation springs 71 and 72 are preferably under compression.

Figure 8:
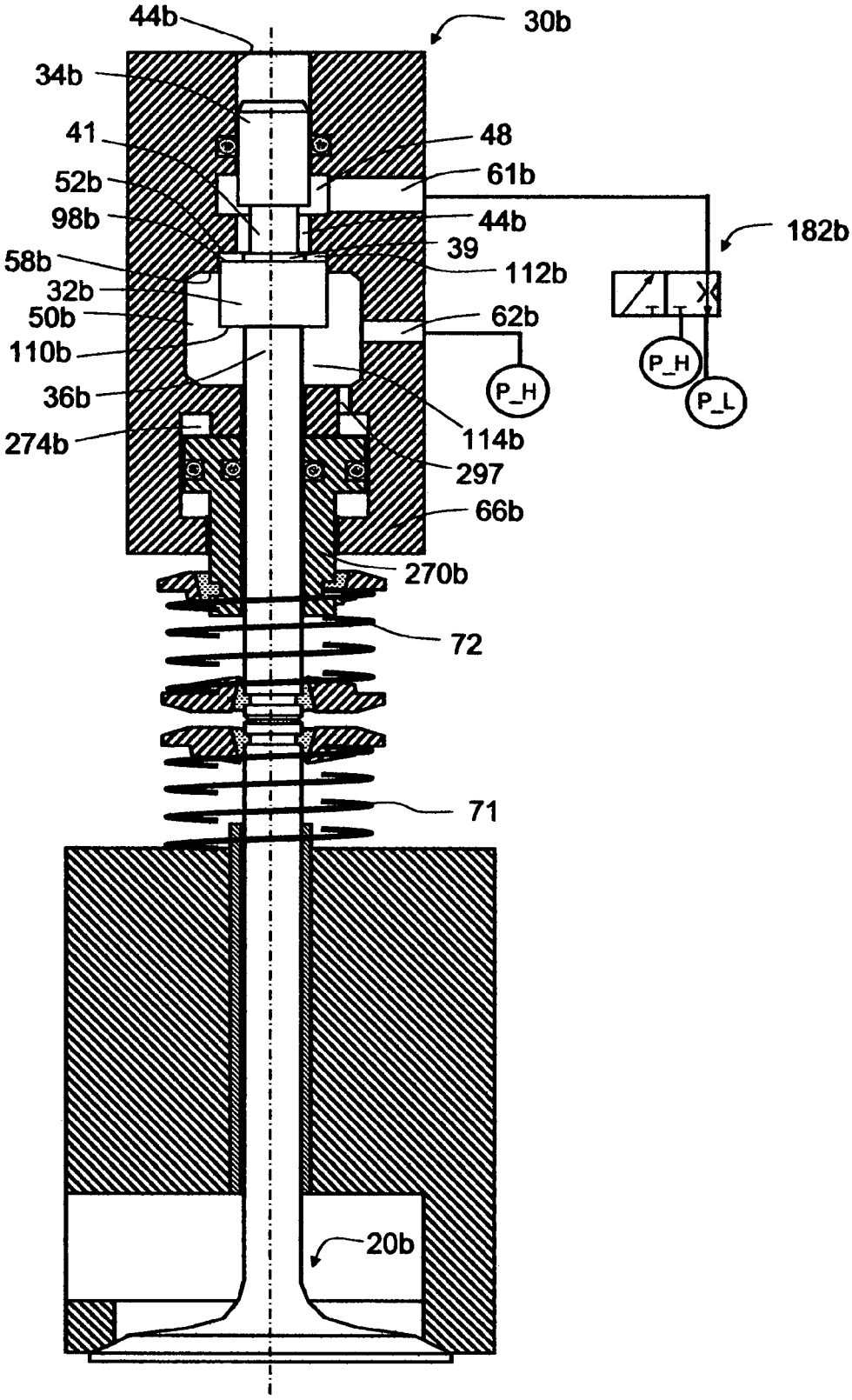
FIG. 8 is a schematic illustration of another preferred embodiment which opens an engine valve in the second direction and utilizes one actuation three-way valve.
Figure 9:
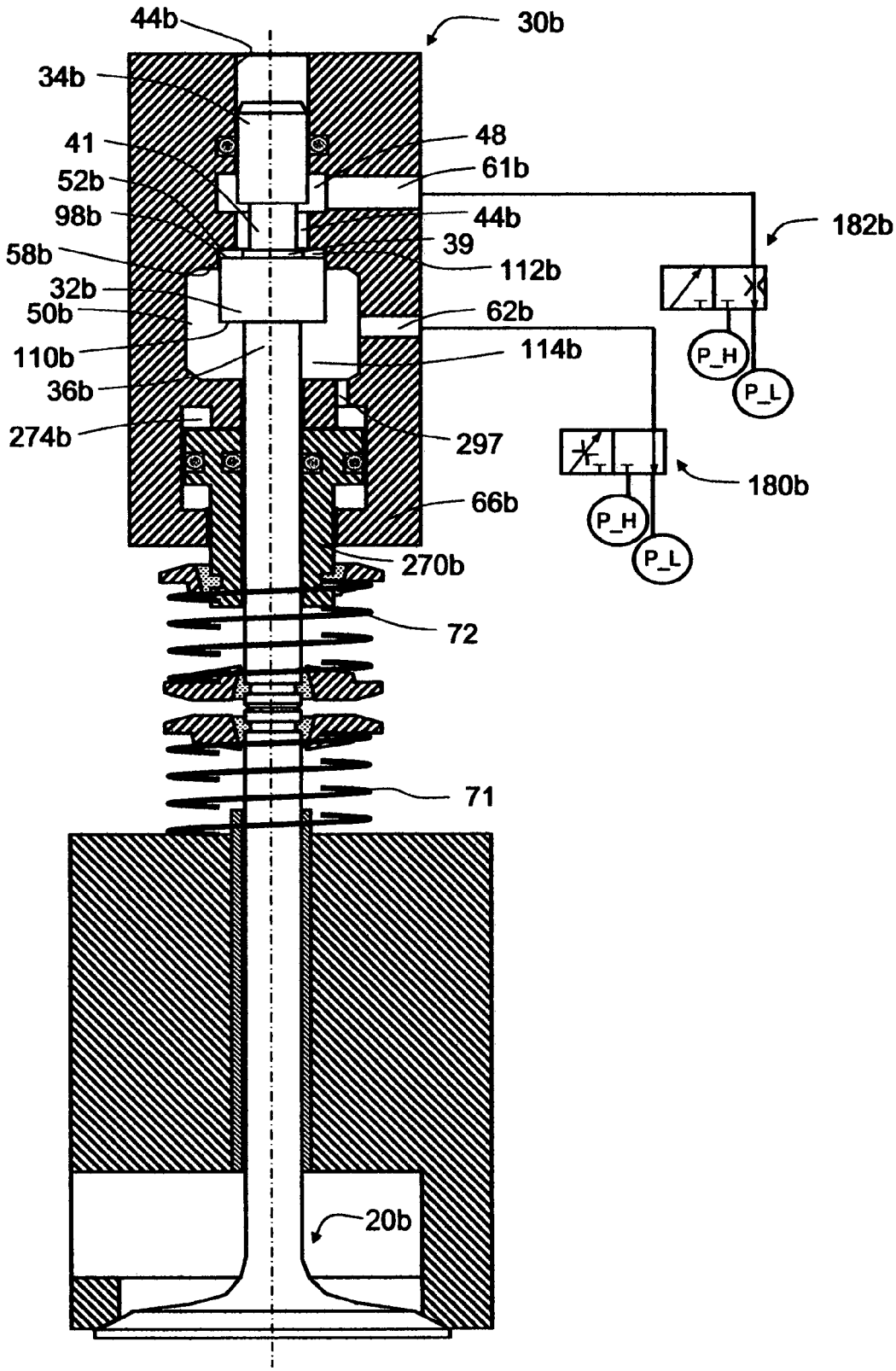
FIG. 9 is a schematic illustration of another preferred embodiment which opens an engine valve in the second direction and utilizes two actuation three-way valves.
Figure 10:
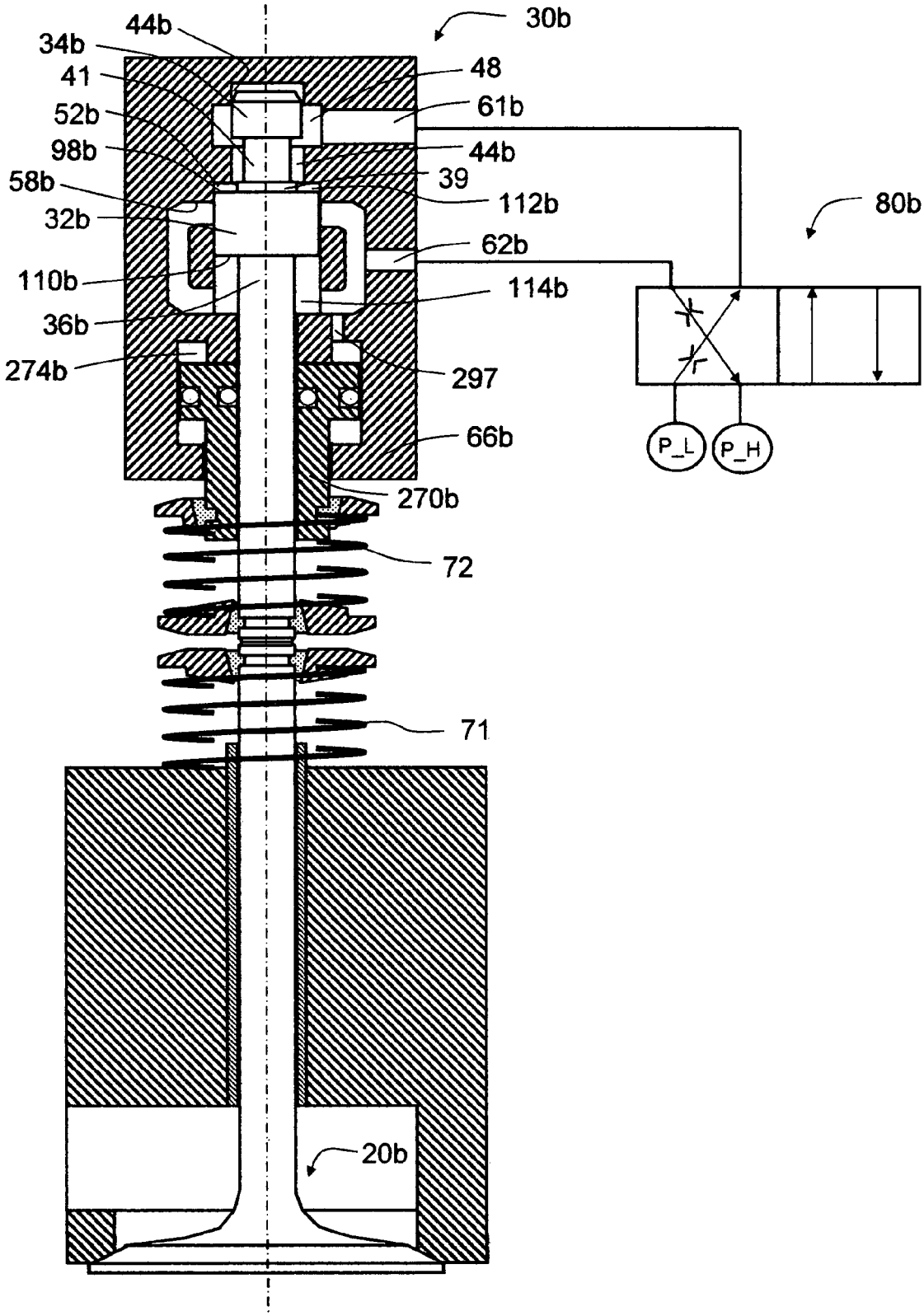
FIG. 10 is a schematic illustration of another preferred embodiment which opens an engine valve in the second direction and utilizes one actuation switch valve.

The first spring retainer 76 is operably connected with the engine valve stem 24 and the second piston rod 36. Some part or element of this connection can be a simple mechanical contact as long as they move inseparably, which may be secured for example by designing proper spring preloads. If desired, the retainer 76 can be designed into two separate retainers as shown in FIGS. 8-10.

Figure 6:
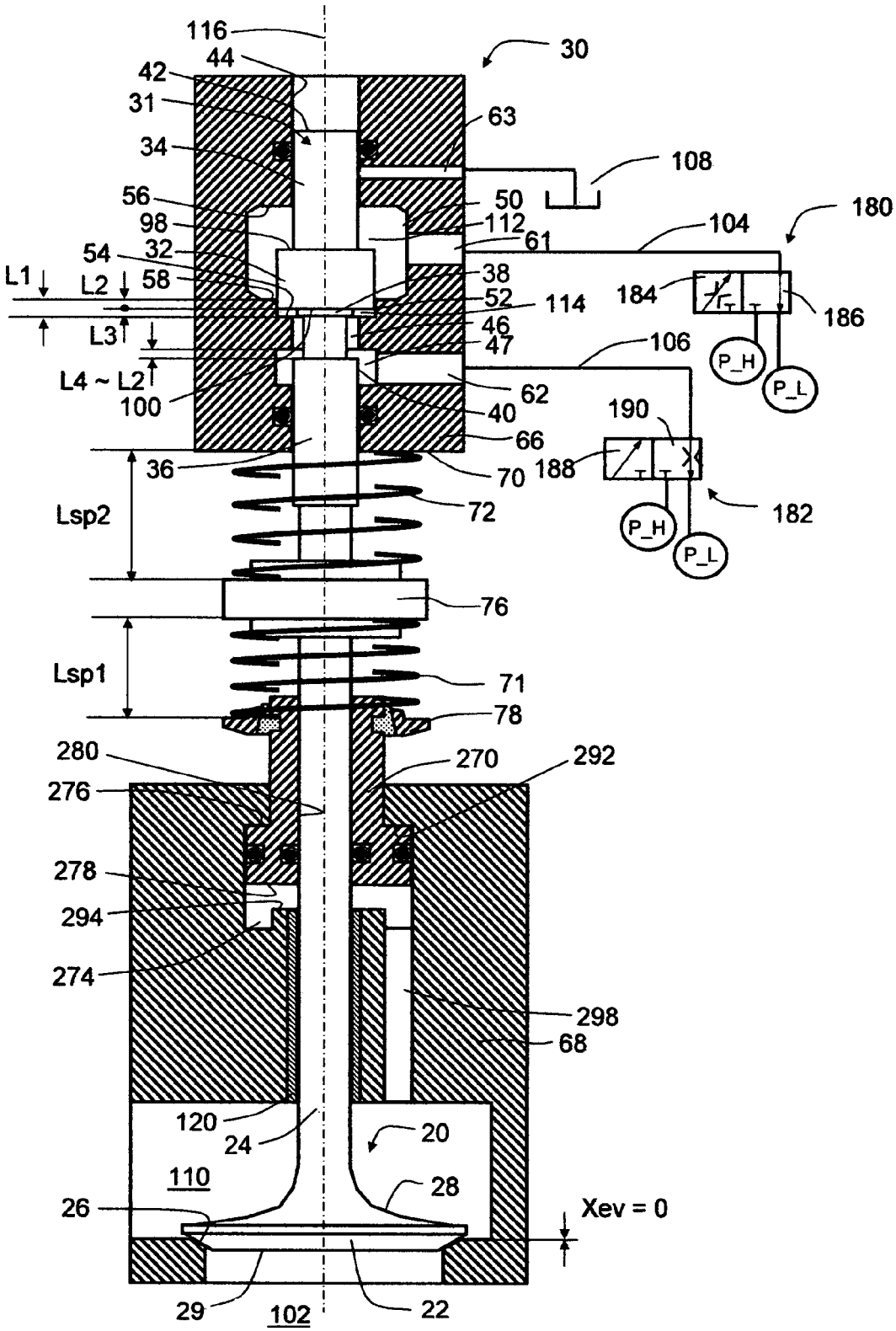
FIG. 6 is a schematic illustration of another preferred embodiment which utilizes two actuation three-way valves.

The second spring retainer 78 is supported by a spring controller 270. The spring controller 270 includes a spring-controller bore 280 sliding over the engine valve guide 120 as shown in FIG. 1, or the engine valve stem 24 if the engine valve guide 120 is shorten toward the second direction as shown in FIG. 6. The controller 270 partitions a cavity in the engine cylinder head 68 into a spring-controller first and second chambers 272 and 274. The second chamber 274 is supplied, through a spring-controller port 296, with the working fluid from a fluid source P_SP. The second chamber 272 being preferably in communication with the atmosphere or a fluid return line (details of which not shown in FIG. 1). Structurally, the spring controller 270 and its associated chambers 272 and 274 and port 296 can be alternatively supported by an extended part of the housing 66, which is assembled on to the cylinder head 68.

The longitudinal position of the spring controller 270 results primarily from the balance between the fluid pressure force on a spring-controller second surface 278 in the first direction and the spring force from the first actuation spring 71 in the second direction, and it is limited in the first and second directions when spring-controller first and second surfaces 276 and 278 come in contact with spring-controller chamber first and second surfaces 292 and 294 respectively. The pressure of the fluid source P_SP can be switched between a high value and a low value to position the spring controller 270 in two end positions in the first and second directions, respectively. If desired, the pressure of the fluid source P_SP can also be continuously controlled to situate the controller 270 in between its two end positions. If so, because of the variability of the spring force with the engine valve opening and closing, some damping mechanism (not shown in FIG. 1) is needed to limit the position oscillation of the spring controller 270. The fluid source S_SP can be simply the high pressure P_H line. Alternatively, it can tap into the engine lubrication supply system, and the same fluid is used to lubricate the engine valve stem 24 and the engine valve guide 120.

When the spring controller 270 is at its second direction end position (as shown in FIG. 1) because of a low or zero pressure in the second chamber 274 at a power-off state or during an actuator initialization, the two actuation springs 71 and 72 are at their least compressed state, and their static, net total force tends to move, by design, the engine valve 20 to a closed position, with an additional seating force if desired. When the spring controller 270 is at its first direction end position (as shown in FIGS. 2-5) because of a high pressure in the second chamber 274, the two springs 71 and 72 are together at their most compressed state, and their static, net total force tends to bias the engine valve 20, in most designs, to a substantially middle point between the fully open and closed positions, setting up the system for its normal pendulum actuation. A position where the net or total spring force is zero is also called a neutral position. When desired, the engine valve neutral position can also be away from the substantial middle point between the fully open and closed positions. While the actuation springs 71 and 72 tend to bias the engine valve 20 to a neutral position, the actual position is also influenced by fluid forces on the actuation piston 32, the air forces on the engine valve head 22, inertia force during opening and closing, etc. The two springs 71 and 72 can be either identical or not in their designs and force curves.

The second-piston-rod shoulder 38 is intended to work with the second bore 46 as a snubber to slow down the shaft assembly 31 near the end of its travel in the second direction. When traveling in the first direction, the second actuation spring 72 always stalls the shaft assembly 31 and the engine valve 20 well before the actuation-piston first surface 98 is able to contact the actuation-cylinder first end 56.

The shaft assembly 31 is generally under two longitudinal fluid forces on the actuation-piston first and second surfaces 98 and 100. The effective pressure areas of the two surfaces 98 and 100 are influenced by the diameters of the first and second piston rods 34 and 36. As an option, the actuator can be designed without the first piston rod to provide much more effective pressure area on the surface 98. In FIG. 1, a first chamber 45, distal to a first-piston-rod end surface 42, is either in direct communication with the atmosphere, or with a fluid tank 108 through a third port 63 to collect the leaked fluid. The first-piston-rod, end surface 42 is therefore not exposed to any substantial pressure or pressure force.

The engine valve head 22 is generally exposed to the pressure of the crossover valve passage on the first surface 28 and the pressure of the engine cylinder 102 on the second surface 29.

The system also experiences various friction forces, steady-state flow forces, transient flow forces, and other inertia forces. Steady-state flow forces are caused by the hydrostatic pressure redistribution due to flow induced velocity variation, i.e. the Bernoulli effect. Transient flow forces are fluid inertial forces. Other inertial forces result from the acceleration of objects, excluding fluid here, with inertia, and they are substantial in an engine valve assembly because of the large magnitude of the acceleration or the fast timing.

The fluid flow control within the actuator 30 can be considered to include a first flow mechanism, a second flow mechanism, and a bypass. The first and second flow mechanisms control fluid communication between the first fluid space 112 and the first port 61 and that between the second fluid space 114 and the second port 62, respectively. The bypass controls fluid communication between the first and second fluid spaces 112 and 114. For the preferred embodiment illustrated in FIG. 1, the first flow mechanism is direct (not shown in FIG. 1) or indirect (through the bypass undercut 50) connection between the first fluid space 112 and the first port 61. The second flow mechanism includes the second-bore undercut. 47, the annular space between the second bore 46 and the second-piston-rod neck 40, the second piston rod 36, and the second-piston-rod shoulder 38. The bypass includes the bypass undercut 50. The first flow mechanism is always open, while the second flow mechanism is substantially open and closed when the bypass is closed and open, respectively.

Power-Off State

At power-off, all fluid supply sources, including the fluid supply source P_SP, are at low or zero gage pressure. The spring controller 270 is thus at the second direction end position as shown in FIG. 1 under the spring force from the first actuation spring 71. The total fluid force on the actuation piston 32 is substantially equal to zero. The actuation springs 71 and 72 are at their least compressed states, and their net force urges the engine valve 20 in a closed position as shown in FIG. 1, with the contact force from the engine valve seat 26 balancing the net spring force if assuming a negligible gravitational force. The level of the contact force can be predesigned. When the actuation springs 71 and 72 are substantially symmetric or identical in their designs, the seating contact force is equal to the total spring stiffness times the spring length differential (Lsp1−Lsp2). The spring lengths Lsp1 and Lsp2 should be substantially equal if the contact force approaches zero.

At the power-off, the actuation switch valve 80 is preferably, but, not necessarily, in its left position 82 as shown in FIG. 1, so that it does not have to be switched at the start-up.

Start-Up

Figure 2:
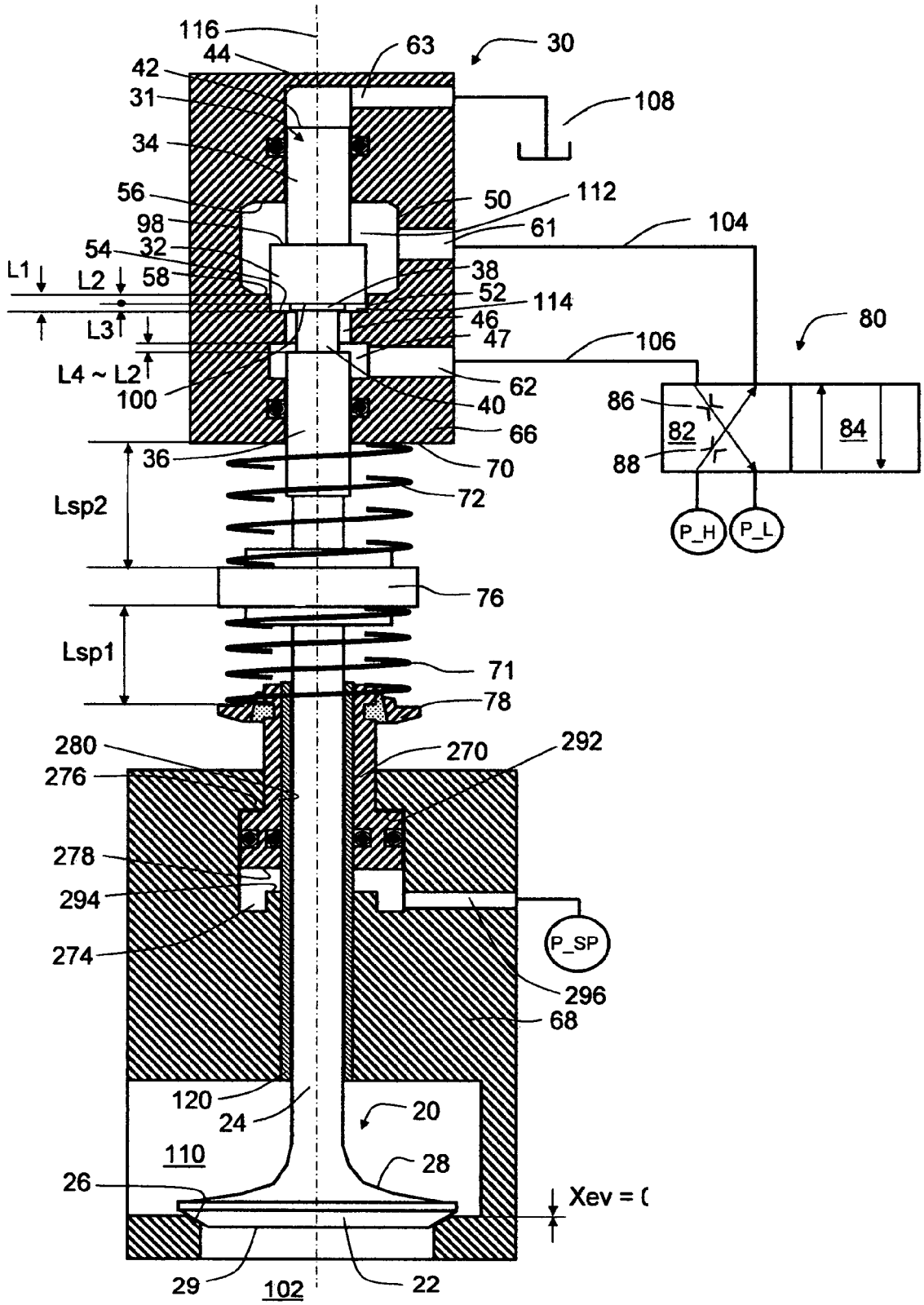
FIG. 2 is a schematic illustration of one preferred embodiment of the valve actuator, which is complete with initialization or in a closed state.

To start-up the system from the power-off state as shown in FIG. 1, all fluid supply sources, including that of P_SP, are pressurized, the actuation switch valve 80 is secured at (or switched to if not already at the power-off state) its left position 82, resulting in high and low pressures in the first and second fluid spaces 112 and 114, respectively, and thus a net fluid force on the actuation piston 32 in the second direction. Also, the spring controller 270 is pushed by the fluid pressure in the spring-controller second chamber 274 to its first direction end position to increase the overall compression of the first and second actuation springs 71 and 72 and to move the neutral position of the pendulum in the first direction. As shown in FIG. 2, the length Lsp1 of the first actuation spring 71 is now appreciably shorter than the length Lsp2 of the second actuation spring 72 once the start-up is complete although the two springs 71 and 72 in this case are assumed to have identical design.

It is beneficial to establish the differential fluid force on the actuation piston 32 and latch the piston in its position as shown in FIG. 2 before there is a substantial movement of the spring controller 270 in the first direction. This time delay may happen naturally since it takes much more fluid volume and thus more time to fill an expanding or moving volume like the spring-controller second chamber 274 than to pressurize a fixed volume like that of the actuation cylinder 52 and its bypass undercut 50. This time delay can also be enforced by various means. For example, either another switch valve (not shown in FIG. 2) or an artificially restrictive flow passage can be added between the spring-controller port 296 and the fluid source P_PS. For simplicity, one fluid source P_PS and one delay switch valve can be used by several actuators in an engine.

Valve Opening and Closing

To open the engine valve 20, the actuation switch valve 80 is turned to the right position 84 as shown in FIG. 3, wherein the first and second ports 61 and 62 are connected with the low pressure P_L and high pressure P_H, respectively. Due to the open communication with the second port 62 through the second bore undercut 47 and the annular space between the second bore 46 and the second-piston-rod neck 40, the pressure in the second fluid space 114 rises quickly from the low pressure P_L to a value close to the high pressure P_H. Due to open fluid communication with the first port 61, the pressure in the first fluid space 112 drops quickly from the high pressure P_H to a value close to the low pressure P_L. The resulting net pressure force on the actuation piston 32 works with the net spring force to drive the shaft assembly 31 and the engine valve 20 in the first direction, overcoming the cross-over passage air pressure force on the engine valve first surface 28. The net fluid pressure on the actuation piston 32 remains to be substantial and in the first direction as long as the engine valve displacement Xev remains to be less than L2.

Figure 4:
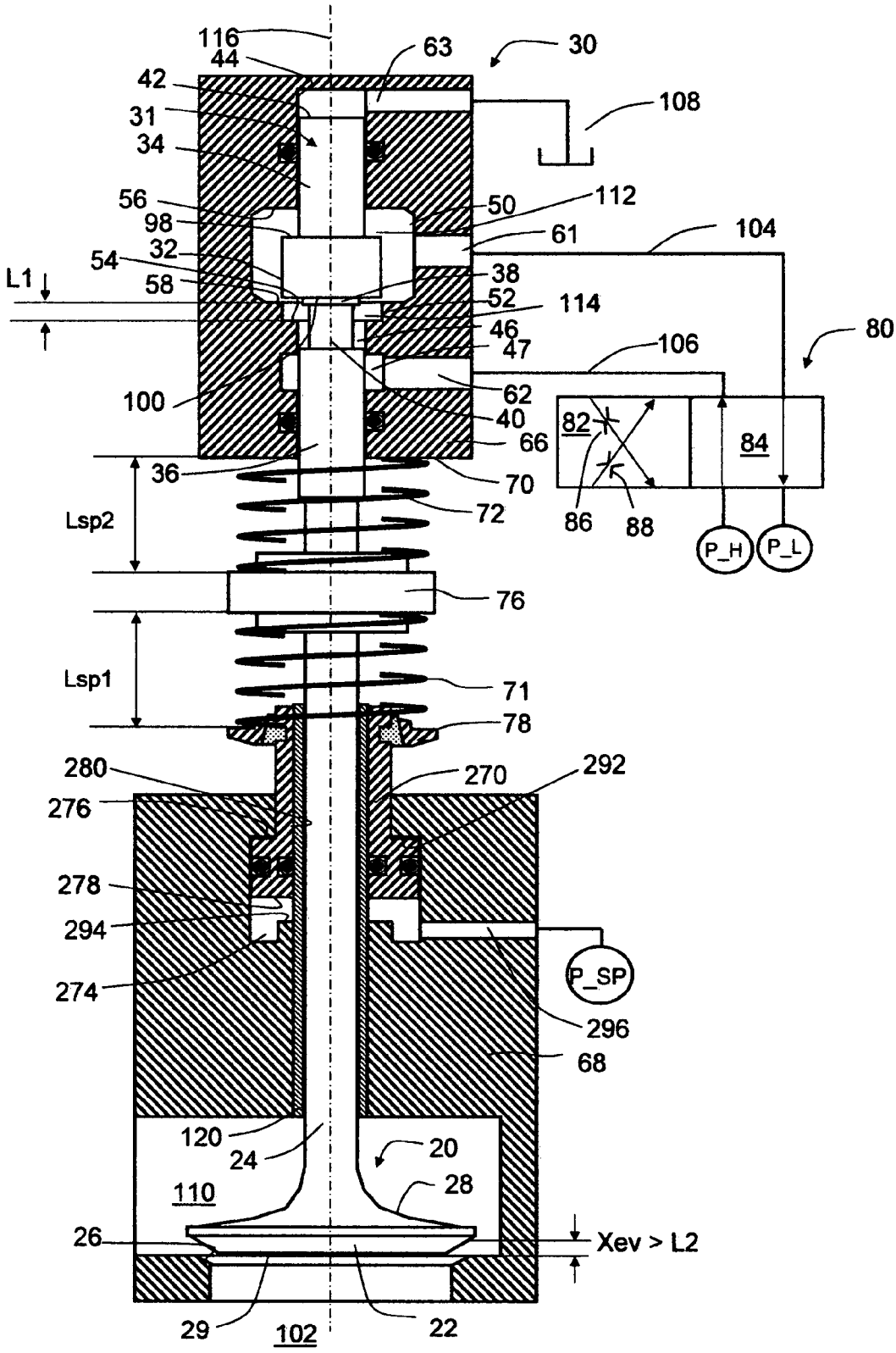
FIG. 4 is a schematic illustration of one preferred embodiment of the valve actuator, which has substantially opened an engine valve, with the bypass being open.

When the engine valve displacement Xev exceeds L2 as shown in FIG. 4, the second piston rod 36 completely overlaps the second-bore undercut 47 and blocks fluid communication between the second fluid space 114 and the second port 62, resulting in a zero fluid flow through the second port 62. At the same time, the actuation-piston second surface 100 is over the bypass edge 58 in the first direction, opening up the fluid communication between the two fluid spaces 112 and 114 and equalizing the pressure on the actuation-piston first and second surfaces 98 and 100. The bypass flow between the two fluid spaces 112 and 114 substantially reduces the need for fluid flow to or from the first port 61. When the first and second piston rods 34 and 36 have substantially the same diameter, there is substantially zero fluid flow through the first port 61, and the net pressure force on the actuation piston 32 is substantially, equal to zero if the flow resistance in the bypass undercut 50 is ignored. At this state, the shaft assembly 31 and the engine valve 20 continue to travel in the first direction against the net spring force and potentially some residual differential air pressure force on the engine valve 20, with their speed being reduced and most of their kinetic energy being converted into the potential energy in the springs 71 and 72.

Eventually, the shaft assembly 31 and the engine valve 20 become completely stalled and reach their maximum displacement in the first direction (not shown in the figures). After that point, they start traveling back in the second direction under the spring force, converting the potential energy in the springs 71 and 72 back into the kinetic energy for the shaft assembly 31 and the engine valve 20.

To get ready to latching the returning actuation piston 32 in the second direction end position, the actuation switch valve 80 is switched back into the left position 82, preferably before the actuation-piston second surface 100 passes under the bypass edge 58 in the second direction, i.e., before the bypass is disabled. The displacement-time curve of the engine valve 20 is not substantially sensitive to the exact time of this switch action as long as it occurs while the bypass is still effective.

Figure 5:
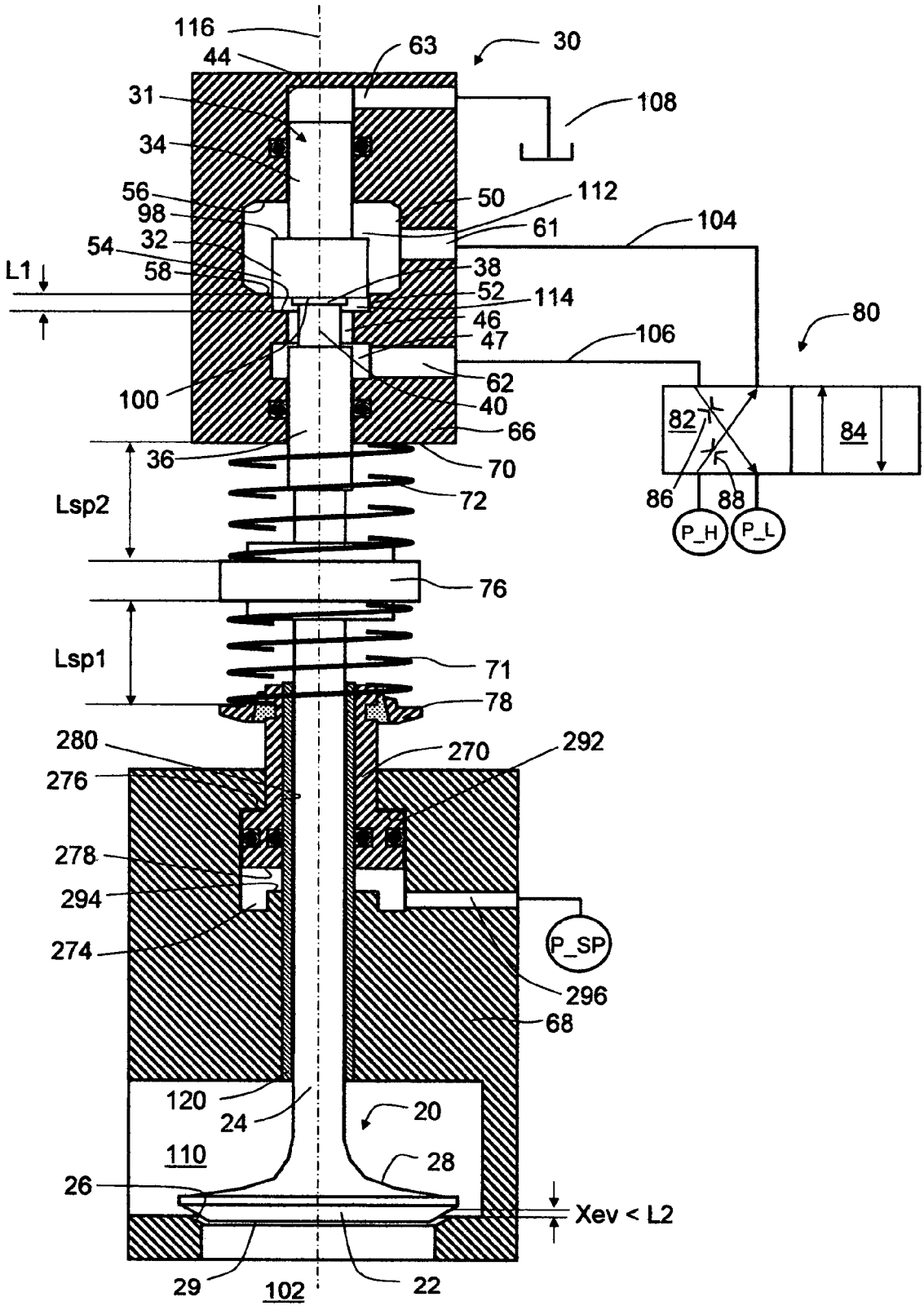
FIG. 5 is a schematic illustration of one preferred embodiment of the valve actuator, which is about to close an engine valve, with the bypass being closed.

Once the bypass is disabled, the second piston rod 36 underlaps at least part of the second-bore undercut 47 as shown in FIG. 5, and the first and second fluid spaces 112 and 114 are in fluid communication with the high-pressure P_H and low-pressure P_L supply lines. The second-piston-rod shoulder 38 is intended to work with the second bore 46 as a snubbing mechanism to restrict the flow out of the second fluid space 114 and reduce the seating velocity of the engine valve 20 near the end of the stroke in the second direction. To further assist the snubbing effect, one may add restrictive features or size limits 86 and 88 to the left passages or ports in the actuation switch valve 80. If the approaching speed of the actuation piston 32 is fast, the resulting larger pressure drops across the restrictive passages or ports 86 and 88 induce a smaller differential fluid pressure across the actuation piston 32 in the second direction. The differential fluid pressure force on the piston may point in the first direction when the approaching speed is too fast. The actuation springs 71 and 72 also work to slow down the engine valve 20, with their net force being in the first direction during this part of the stroke, converting the kinetic energy of the shaft assembly 31 and the engine valve 20 into the spring potential energy. With the shoulder 38, the springs 71 and 72, and the restrictive ports 86 and 88, the engine valve 20 is slowed down to an acceptable seating velocity. The restrictive features or ports 86 and 88 or other snubbing mechanism can also be designed to be thermally sensitive so that they are more restrictive at higher fluid temperature to compensate for temperature variation.

While the snubbing is in action, the actuation piston 32 is also prevented from backing away from seating and is eventually latched because the differential, pressure recovers substantially close to a value of (P_H−P_L) as soon as the piston 32 slows down. The resulting differential fluid pressure force on the actuation piston 32 is designed to be sufficient to counter the returning spring force in the first direction plus any differential air pressure force across the engine valve head 22. The air pressure in the engine cylinder 102 may exceed the air pressure in the cross-over passage 110 in certain part of the combustion period, resulting in a net air pressure force in the first direction. After the combustion, the engine cylinder pressure drops rapidly while the cross-over passage pressure remains substantially high, when the net air pressure force helps keep the engine valve 20 seated. At the latched position, the state of the valve actuation system is back to the same state as that depicted in FIG. 2, ready for the next cycle.

In this invention, no attempt is made to hold or latch the actuation piston 32 and thus the engine valve 20 at their maximum opening position. They are driven substantially by the actuation springs 71 and 72 alone once the bypass is effective, and they are driven back in the second direction as soon as reaching their maximum opening, i.e., no dwell time. It is so designed to reduce the total opening and closing time, which is highly desired for the cross-over valve in an air hybrid engine. Without spending energy to latching the valve at the maximum opening, it also saves energy.

FIG. 6 depicts an alternative embodiment of the invention that utilizes first and second actuation 3-way valves 180 and 182, instead of one 4-way switch valve 80 as in FIGS. 1-5. The first and second actuation 3-way valves 180 and 182 control the fluid communication to the first and second ports 61 and 62, respectively. Using two separate valves provides more control flexibility. The two ports 61 and 62 do not necessarily have to have the opposite pressure polarities. For example, both first and second ports 61 and 62 may be at the low-pressure P_L (as shown in FIG. 6), which reduces fluid leakage, when the engine valve 20 is securely seated under a high cross-over passage air pressure and a low engine cylinder air pressure.

The embodiment in FIG. 6 also features a spring controller passage 298 that provides fluid communication between the cross-over passage 110 and the spring-controller second chamber 274, which provides an alternative way to control the spring controller 270. When the power being off and the cross-over passage 110 and thus the spring-controller second chamber 274 being out of pressurized gas or air, the spring controller 270 is situated at the second direction end position, resulting in a spring neutral position shifted in the second direction and a seated engine valve 20 under the spring forces. When the cross-over passage 110 being at a moderate to high pressure, the same pressure will be present in the spring-controller second chamber 274, resulting in appropriately compressed actuation springs 71 and 72 as shown in FIG. 6, fit for the normal pendulum operation.

The embodiment in FIG. 6 illustrates that the spring controller 270 can slide over the engine valve stem 24, instead of the extended engine valve guide 120 as in FIGS. 1-5.

Figure 7:
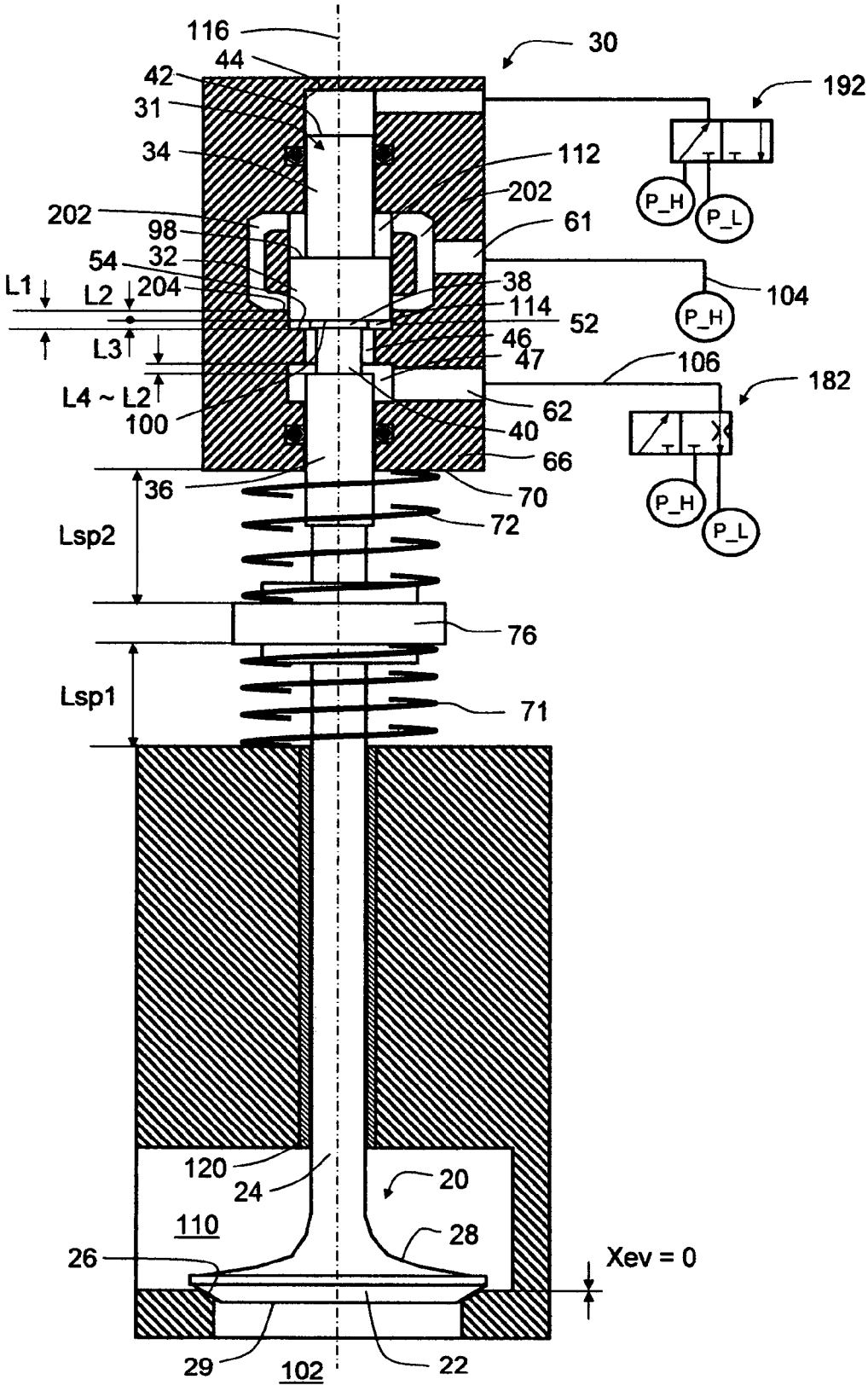
FIG. 7 is a schematic illustration of another preferred embodiment which utilizes one actuation three-way valve and one optional startup switch valve.

FIG. 7 depicts another preferred embodiment of the invention that features three major variations. First, the first port 61 is connected only with the high pressure P_H supply line, without control of a switch valve. During the opening stroke of the engine valve 20 in the first direction, both sides of the actuation piston 32 will be under the high pressure P_H, and the moving mass will be driven only by the actuation springs 71 and 72, without the help of a favorable differential fluid force. This variation only needs one, instead of two, actuation 3-way valve 182, a much simpler arrangement. It is suitable for applications where frictional energy losses (including those to overcome the differential air force on the engine valve 20) are not substantial. The energy losses during the opening stroke (the travel in the first direction) can be compensated during the closing stroke (the travel in the second direction) when the flow bypass is not effective.

Second, the flow bypass in the actuation cylinder 52 is realized by at least one bypass passage 202. The actuation cylinder 52 is longitudinally divided, by the actuation piston 32, into first and second fluid spaces 112 and 114. The function of the bypass undercut 50 (as shown in FIG. 1) is replaced by the at least one bypass passage 202, which opens up fluid communication between the first and second fluid spaces 112 and 114 when the actuation-piston second surface 100 moves over, in the first direction, a bypass edge 58. The at least one bypass passage 202 is preferably to be geometrically axial-symmetric to result in axial-symmetric or balanced fluid forces on the shaft assembly 31. If two bypass passages 202 are used, for example, they are preferably to be 180 degree apart. The first port 61 is connected with the first fluid space 112 either directly (not shown in FIG. 7) or indirectly through at least one bypass passage 202 (as shown in FIG. 7).

The third feature of the embodiment illustrated in FIG. 7 is its lack of the spring controller 270 (as shown in FIG. 1). The function of initializing the actuator, i.e. seating the engine valve 20 at the engine start-up, can be completed by enclosing the first bore 44 structurally and pressurizing with the first-piston-rod end surface 42 with a startup switch valve 192. At normal operation, the startup switch valve 192 is kept at its right position to expose the first-piston-rod end surface 42 with the low pressure P_L to minimize energy losses. The same startup switch valve 192 can be shared by more than one actuator. As an alternative, the actuator 30 may be started without the startup switch valve 192. Instead, the actuator 30 may be designed in such a way that the actuation-piston second surface 100 is still not over, in the first direction, the bypass edge 58 when the power is off. At the startup, the second fluid space 114 is not in fluid communication with the first fluid space 112, and the high pressure P_H in the first fluid space 112 and the low pressure P_L in the second fluid space 114 are able to drive the shaft assembly 31 in the second direction and seat the engine valve 20.

Refer now to FIG. 8, which is a drawing of yet another alternative embodiment of the invention. In this case, the engine valve **20*b* is opened in the second direction as in most conventional internal combustion engines. Therefore, the bypass undercut 50***b* is longitudinally located at the second direction end of the actuation cylinder 52*b*. The second fluid space 114*b* is in un-interrupted fluid communication with the second port 62*b* through the bypass undercut 50*b*, whereas the first fluid space 112*b* is in fluid communication with the first port 61*b* and the second fluid space 114*b*, respectively, when the actuation-piston first surface 98*b* is over (in the first direction) and under (in the second direction) the bypass edge 58*b*, i.e. when the bypass is ineffective and effective. The fluid communication between the first fluid space 112*b* and the first port 61*b* is through a first-bore undercut 48 and an annular space between the first bore 44*b* and the first-piston-rod neck 41. A first-piston-rod shoulder 39 works with the first bore 44*b* to provide snubbing action needed for soft seating of the engine valve 20*b* in the first direction. The spring controller 270*b* is slideably disposed in the housing 66*b* and over the second piston rod 36*b* to control the position of the first direction end of the second actuation spring 72. The spring controller 270*b* is longitudinally balanced by the force from the second actuation spring 72, the fluid force from the spring-controller second chamber 274*b*, and a contact force when it is longitudinally limited by the housing 66*b*. The spring-controller second chamber 274*b* is supplied either from a separate fluid supply (not shown in FIG. 8) or from the second port 62*b* through a spring-controller passage 297 and, optionally, the bypass undercut 50*b* or the second fluid space 114*b*. Like the embodiment illustrated in FIG. 7, one has the option of not using the spring controller at all. Instead, the startup may be achieved either by using a startup switch valve like the valve 192 shown in FIG. 7 or simply keeping, by design, the bypass substantially ineffective when the net spring force is zero.

The first port 61*b* is connected to the high-pressure P_H and low-pressure P_L fluid lines through the second actuation 3-way valve 182*b*, whereas the second port 62*b* is directly connected with the high-pressure P_H fluid line.

For the preferred embodiment illustrated in FIG. 8, the second flow mechanism is a wide-open connection, through the bypass undercut 50*b*, between the second fluid space 114*b* and the second port 62*b*. The first flow mechanism includes the first-bore undercut 48, the annular space between the first bore 44*b* and the first-piston-rod neck 41, the first piston rod 34*b*, and the first-piston-rod shoulder 39. The bypass includes the bypass undercut 50*b*. The second flow mechanism is always open, while the first flow mechanism is substantially open and closed when the bypass is closed and open, respectively.

At the engine power-off state, both fluid sources P_H and P_L are at or near zero gage pressure, and the spring-controller second chamber 274*b* is not pressurized. The spring controller 270*b* is therefore at its first direction end position (as shown in FIG. 8), resulting in a closed engine valve as shown in FIG. 8. At the engine start-up, the second actuation 3-way valve 182*b* is at its right position (as shown in FIG. 8), resulting in a differential pressure in the first direction on the actuation piston 32*b* to lock up the piston 32*b* in the first direction end position, resulting in a closed engine valve 20*b*. To open the engine valve 20*b*, the second actuation 3-way valve 182*b* is switched to its left position, thus feeding the high pressure P_H fluid to the first port 61*b* and the first fluid space 112*b* and substantially equalizing the pressure at the both sides of the actuation piston 32*b*. The piston 32*b* is then driven by the net spring force to move in the second direction, opening up the engine valve 20*b*. The net spring force decreases its magnitude as the moving mass gaining its speed. Once passing the neutral point where the net spring force is zero, the net spring force turns to be in the first direction and increases its magnitude as the moving mass loses its velocity until being stalled by the spring force. Then the spring-mass pendulum swings in the first direction until the actuation-piston first surface 98*b* passes, in the first direction, the bypass edge 58*b*, by then the second actuation 3-way valve 182*b* has been switched back to its right position to supply the first port 61*b* and the first fluid space 112*b* with the low pressure P_L fluid to create a differentials pressure force in the first direction, which helps keep the actuation piston 32*b* moving in the first direction. At the same time, the seating velocity is limited due to flow restriction created by the first-piston-rod shoulder 39 partially blocking the first bore 44*b* and optional flow restriction at the low pressure metering path in the second actuation 3-way valve 182*b*.

The diameters of the first and second piston rods 34*b* and 36*b* do not have to be identical. It is preferable to have a relatively smaller diameter for the first piston rod 34*b* if more engine valve opening force is desired.

Refer now to FIG. 9, which is a drawing of yet another alternative embodiment of the invention. This embodiment in FIG. 9 is different from that in FIG. 8 primarily in the addition of a first actuation 3-way valve 180*b*. The first actuation 3-way valve 180*b* in FIG. 9 is substantially the same as the first actuation 3-way valve 180 in FIG. 6. It offers the option of exposing the first and second fluid space 112*b* and 114*b* to the high-pressure P_H and low-pressure P_L, respectively, and thus having a differential pressure force in the second direction on the actuation piston 32*b* to help open the engine valve 20*b*

Refer now to FIG. 10, which is a drawing of yet another alternative embodiment of the invention. This embodiment in FIG. 10 is different from that in FIG. 8 primarily in the use of an actuation switch valve 80*b*, instead of the second actuation 3-way valve 182*b*. The actuation switch valve 80*b* in FIG. 10 is substantially the same as the actuation switch valve 80 in FIGS. 1-5 in terms of physical structure and functions, which are explained in details earlier in this application.

In all the above descriptions, the first and second actuation springs 71 and 72 are each identified or illustrated, for convenience, as a single spring. When needed for strength, durability or packaging, however each or any one of the first and second actuation springs 71 and 72 may include a combination of two or more springs. In the case of mechanical compression springs, they can be nested concentrically, for example. The two actuation springs can also be combined into a single mechanical spring (not shown) that can take both tension and compression. They may also include a combination of pneumatic and mechanical springs, or even two pneumatic springs. The two springs can be either identical or not in their designs and force curves. The spring subsystem, either with a single or multiple springs, tends to return the shaft assembly to a neutral position. As a design option, the pneumatic springs may be filled, supplemented, or controlled by the pressurized air or gaseous mixture in the cross-over passage 110. The pneumatic springs may have adjustable mass or pressure to achieve variable spring rate and thus variable valve stroke slope. Use of a pneumatic spring can also help close the engine valve 20 at power-off and startup the valve system. If the first actuation spring 71 in FIG. 1 is a pneumatic one, for example, it can be discharged at power-off to bias the engine valve 20 in the second direction to a seated position, which also helps get the actuator ready for the next startup. After the next startup, the pneumatic spring will be charged again.

In all the above descriptions, each of the switch and/or control valves may be either a single-stage type or a multiplestage type. Each valve can be either a linear type (such as a spool valve) or a rotary type. Each valve can be driven by an electric, electromagnetic, mechanic, piezoelectric, or fluid means.

In some illustrations and descriptions, the fluid medium may be assumed or implied to be in hydraulic or in liquid form. In most cases, the same concepts can be applied, with proper scaling, to pneumatic actuators and systems. As such, the term "fluid" as used herein is meant to include both liquids and gases. Also, in many illustrations and descriptions so far, the application of the invention is defaulted to be in engine valve control, and it is not limited so. The invention can be applied to other situations where a fast and/or energy efficient control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. A fluid actuator, comprising a housing having first and second fluid ports;

an actuation cylinder in the housing defining a longitudinal axis and having first and second ends in first and second directions;

an actuation piston in the cylinder with first and second surfaces moveable along the longitudinal axis;

a second piston rod operably connected with the actuation piston;

a spring subsystem biasing the actuation piston to a neutral position;

a first fluid space defined by the first end of the actuation cylinder and the first surface of the actuation piston;

a second fluid space defined by the second end of the actuation cylinder and the second surface of the actuation piston;

a first flow mechanism in fluid communication between the first fluid space and the first port;

a second flow mechanism in fluid communication between the second fluid space and the second port;

a flow bypass that substantially short-circuits the first and second fluid spaces when the actuation piston is in its entire operating range except for being within a predefined distance from only one of the first and second ends of the actuation cylinder; and at least one of the first and second flow mechanisms being substantially closed when the flow bypass substantially short-circuits the first and second fluid space.

2. The fluid actuator of claim 1, further including a first piston rod.

3. The fluid actuator of claim 1, wherein the spring subsystem further including at least one first actuation spring and at least one second actuation spring.

4. The fluid actuator of claim 1, wherein at least one of the first and second flow mechanisms further involving a piston-rod neck and a bore, whereby providing a flow passage that is substantially interrupted when the actuation piston is beyond a predefined distance from one of the first and second ends of the actuation cylinder.

5. The fluid actuator of claim 1, wherein one of the first and second flow mechanisms being substantially open all the time.

6. The fluid actuator of claim 1, further including a spring controller operably connected with part of the spring subsystem.

7. The fluid actuator of claim 3, further including a spring controller operably connected to one end of one of the first and second actuation springs, whereby controlling its longitudinal position and the operating state of the actuation springs.

8. The fluid actuator of claim 6, wherein the spring controller further including at least one spring-controller second chamber filled with a working fluid, whereby providing a control force to the spring controller.

9. The fluid actuator of claim 1, further including at least one actuation switch valve, whereby controlling fluid supply to the first and second ports.

10. The fluid actuator of claim 9, wherein the at-least-one actuation switch valve being a four-way valve.

11. The fluid actuator of claim 9, wherein the at-least-one actuation switch valve further including restrictive features in one set of the passages, whereby assisting snubbing effort.

12. The fluid actuator of claim 1, further including a snubber, whereby slowing down the actuation piston near the end of its travel in the second direction.

13. The fluid actuator of claim 1, wherein the second piston rod is operably connected with an engine valve.

14. A method of controlling an actuator comprising:

(a) providing an actuator including the following components:

a housing having first and second fluid ports;

an actuation cylinder in the housing defining a longitudinal axis and having first and second ends in first and second directions;

an actuation piston in the cylinder with first and second surfaces moveable along the longitudinal axis;

a second piston rod with one end operably connected with the actuation piston and with the other end available for an operable connection with a load of the actuator;

a spring subsystem biasing the actuation piston to a neutral position;

a first fluid space defined by the first end of the actuation cylinder and the first surface of the actuation piston;

a second fluid space defined by the second end of the actuation cylinder and the second surface of the actuation piston;

a first flow mechanism in fluid communication between the first fluid space and the first port;

a second flow mechanism in fluid communication between the second fluid space and the second port;

a flow bypass that substantially short-circuits the first and second fluid spaces when the actuation piston is beyond a predefined distance from one of the first and second ends of the actuation cylinder; and at least one of the first and second flow mechanisms being substantially closed when the flow bypass substantially short-circuits the first and second fluid spaces;

(b) holding the load of the actuator to a second-direction end position by supplying high and low pressure fluids to the first and second ports, respectively, whereby providing a differential pressure force on the actuation piston in the second direction and balancing out the sum of the rest of the forces including the spring subsystem return force in the first direction;

(c) initiating the travel of the load of the actuator in the first direction by supplying low and high pressure fluids to the first and second ports, respectively, whereby providing a differential pressure force on the actuation piston in the first direction and assisting the spring subsystem return force to overcome the sum of the rest of the forces including those from the load and accelerate the load in the first direction;

(d) continuing the travel in the first direction, with the flow bypass substantially short-circuiting the first and second fluid spaces, and the second flow mechanism being substantially closed when the actuation piston is beyond a predefined distance from the second end of the actuation cylinder;

(e) eventually slowing down the travel and bringing the load to a momentary stop when the spring subsystem return force passes its zero point and becomes increasingly strong in the second direction;

(f) starting a return travel or the travel in the second direction, primarily under the spring subsystem return force in the second direction, immediately after the momentary stop;

(g) continuing the travel in the second direction, primarily under the momentum, after the spring subsystem passes its neutral position, until the actuation piston travels back within the predefined distance from the second end of the actuation cylinder, by then the first and second ports have been switched back to the high and low pressure fluids, respectively;

(h) keeping driving the load in the second direction, against an increasing spring subsystem return force in the first direction, with a differential pressure force on the actuation piston in the second direction, which is made possible by deactivating the flow bypass and opening up the second flow mechanism when the actuation piston is back within the predefined distance from the second end of the actuation cylinder; and (i) helping keep the load at its second direction end position, through the differential pressure force on the actuation piston in the second direction, after the return travel is complete.

15. The method of controlling an actuator of claim 14, further including a first piston rod.

16. The method of controlling an actuator of claim 14, further including a snubber, whereby helping limit the terminal velocity of the load at the end of the return travel.

17. The method of controlling an actuator of claim 14, wherein the spring subsystem further including at least one first actuation spring and at least one second actuation spring.

18. The method of controlling an actuator of claim 14, wherein the second flow mechanism further involving a piston-rod neck and a bore.

19. The method of controlling an actuator of claim 14, wherein the first flow mechanism being substantially open all the time.

20. The method of controlling an actuator of claim 14, further including a spring controller operably connected with part of the spring subsystem, whereby controlling its state of operation.

21. The method of controlling an actuator of claim 20, wherein the spring controller further including at least one spring-controller second chamber filled with a working fluid, whereby providing a control force to the spring controller.

22. The method of controlling an actuator of claim 14, further including at least one actuation switch valve, whereby controlling fluid supply to the first and second ports.

23. The method of controlling an actuator of claim 22, wherein the at-least-one actuation switch valve further including restrictive features in one set of the passages, whereby assisting snubbing effort.

24. The method of controlling an actuator of claim 23, wherein the restrictive features being thermally sensitive and more restrictive at higher fluid temperature.

25. The method of controlling an actuator of claim 14, wherein the second piston rod being operably connected with an engine valve as the load.

* * * * *

UNITED STATES PATENT AND TRADEMARK OFFICE

CERTIFICATE OF CORRECTION

PATENT NO. : 7,421,987 B2
APPLICATION NO. : 11/800586
DATED : September 9, 2008
INVENTOR(S) : Zheng Lou It is certified that error appears in the above-identified patent and that said Letters Patent is hereby corrected as shown below:

Title Page (57) line 4, replace “fluid ports” with --ports--
Title Page (57) line 7, after “second directions” insert --respectively--
Column 2, line 21, delete “fluid”
Column 2, line 23, after “second directions” insert --respectively--
Column 5, line 39, replace “second” with --first--
Column 5, line 63, replace “S_SP” with --P_SP--
Column 6, line 45, delete “valve”
Column 6, line 45, after “passage” insert --110--
Column 7, line 65, replace “P_PS” with --P_SP--
Column 7, line 65, replace “P_PS” with --P_SP--
Column 8, line 64, after “supply lines” insert --respectively--
Column 9, line 3, delete “or size limits”
Column 9, line 6, replace “passages or ports” with --features--
Column 9, line 15, replace “ports” with --features--
Column 9, line 17, delete “or ports”
Column 12, line 9, replace “differentials” with --differential--
Column 13, line 26, delete “fluid”
Column 13, line 29, after “directions” insert --, respectively--
Column 14, line 29, delete “fluid”
Column 14, line 32, after “directions” insert --, respectively--

Signed and Sealed this

Sixth Day of January, 2009

JON W. DUDAS
*Director of the United States Patent and Trademark Office*